United States Patent [19]

Casagrande

[11] Patent Number: 4,805,902

[45] Date of Patent: Feb. 21, 1989

[54] INCLINED-AXIS PENDULUM SWING

[75] Inventor: Joseph E. Casagrande, Dayton, Ohio

[73] Assignee: Spalding & Evenflo Companies, Inc., Tampa, Fla.

[21] Appl. No.: 67,913

[22] Filed: Jun. 30, 1987

[51] Int. Cl.[4] ..... A63G 9/16

[52] U.S. Cl. ..... 272/86; 297/250; 297/273

[58] Field of Search ..... 272/85, 86, 87, 88, 272/89, 90, 91, 83 A, 33; 5/101, 103, 108, 109; 297/273, 274, 387, 250

[56] References Cited

U.S. PATENT DOCUMENTS

| | | | |
|---|---|---|---|
| 461,541 | 10/1891 | Bunker . | |
| 822,329 | 6/1906 | Wilcox | 272/85 |
| 1,569,045 | 1/1926 | Sommer . | |
| 2,551,267 | 5/1951 | Hegewald | 297/274 X |
| 2,697,477 | 12/1954 | Welsh . | |
| 2,916,745 | 12/1959 | Lesk et al. . | |
| 3,040,342 | 6/1962 | Broers . | |
| 3,059,271 | 10/1962 | Erickson | 292/304 X |
| 3,256,016 | 6/1966 | Berlin . | |
| 3,371,358 | 3/1968 | Shackel . | |
| 3,402,962 | 9/1968 | Ellis et al. . | |
| 3,526,400 | 9/1970 | Carpenter et al. | 272/86 |
| 3,528,657 | 9/1970 | Krupsky . | |
| 3,564,626 | 2/1971 | Nelson . | |
| 3,708,144 | 1/1973 | Nasmith . | |
| 3,730,587 | 5/1973 | Bloxham et al. . | |
| 3,806,117 | 4/1974 | Foster . | |
| 4,165,872 | 8/1979 | Saint | 272/86 |
| 4,181,356 | 1/1980 | Fleischer . | |
| 4,256,300 | 3/1981 | Boucher . | |
| 4,271,627 | 6/1981 | Echterling . | |
| 4,324,432 | 4/1982 | Eldon, III et al. . | |
| 4,570,956 | 2/1986 | Dyer . | |

*Primary Examiner*—David A. Scherbel
*Assistant Examiner*—Richard E. Chilcot, Jr.
*Attorney, Agent, or Firm*—Donald R. Bahr; John E. Benoit

[57] ABSTRACT

An infant swing having a base, upwardly extending legs, and a coil spring-wound motor mounted on said legs, with the axis of said coil spring motor extending at a predetermined angle from the vertical above said base. A carriage is mounted to the motor such that it is driven by and oscillates about the axis of the spring. A swing support rod has one leg removably mounted to said carriage parallel to the axis of the spring, with the other leg extending substantially vertically downward and terminating in a substantially horizontal radle for supporting an infant seat beneath the carriage, whereby the oscillatory motion of the carriage causes the seat to swing in a substantially horizontal arcuate path. The infant seat is removably mounted to said cradle.

22 Claims, 5 Drawing Sheets

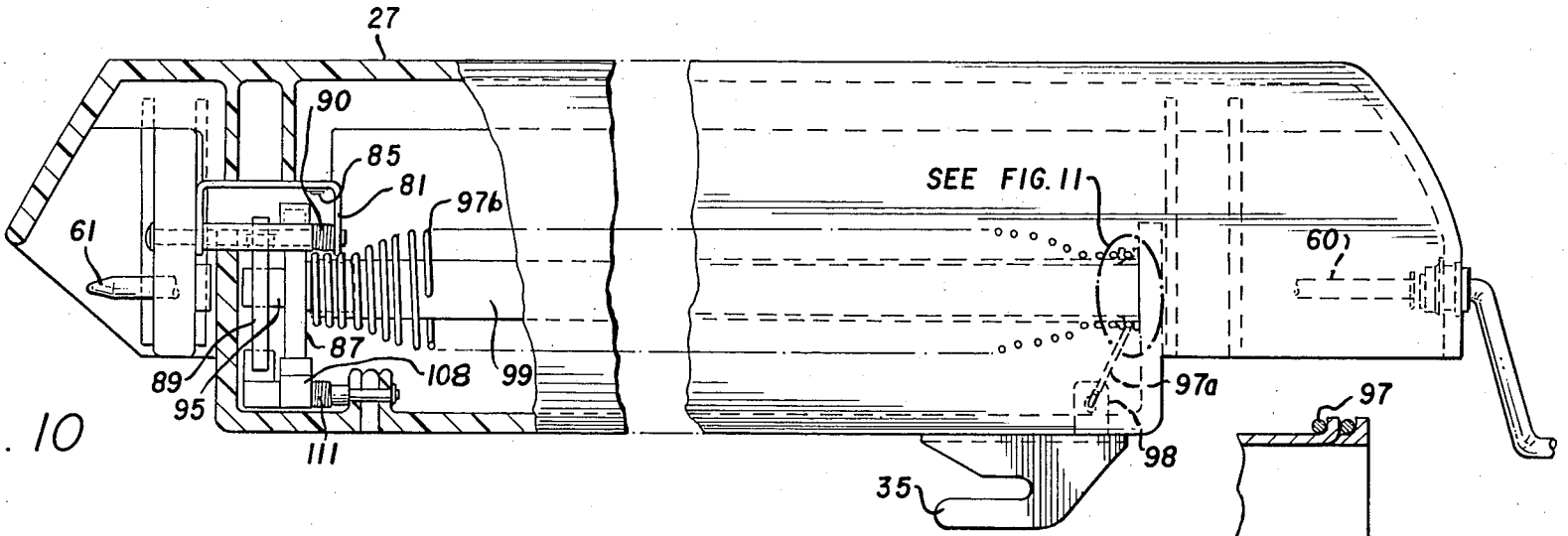
FIG. 10
FIG. 11
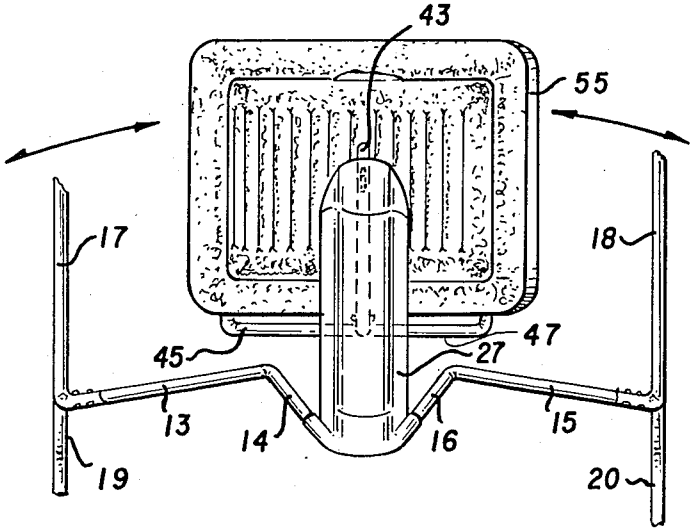
FIG. 9

INCLINED-AXIS PENDULUM SWING

This invention relates generally to infant swings and, more particularly, to an infant swing which provides a horizontal arcuate motion when in operation and also provides a swing having a removable infant seat.

Child swings have been in existence and on the market for a number of years. These swings are particularly designed to place an infant in a seat and to impart a continuous swinging motion so as to sooth the infant while the attending adult may perform other functions.

Available swings have generally been of two types, the first being the swing that oscillates between two support legs extending above a base. The second type of swing provides a seat extending outwardly from the support legs and which swings parallel to the plane of the legs.

In all of these types of swings, the motion of the swing is in an arcuate, straight-line motion through a plane vertical with the surface on which the swing rests. Such motion, while lending some comfort to the infant, does not provide the normal rocking motion that an infant receives when held in the arms of an adult. Such an adult rocking motion provides an arcuate motion which is substantially horizontal to the plane or the ground on which the adult is standing; this is a desirable motion for soothing an infant.

Further, all of the existing swings known to me are unitary and, while being of a number of pieces which may be erected or dismantled, all include permanent infant seats. This limits the use of the seat to that of the swing.

It is an object of this invention to provide an infant swing which provides an oscillatory motion to the seat which is substantially arcuate in a horizontal plane substantially parallel to the plane of the floor upon which the swing is placed.

A further object of this invention is to provide a swing which permits the use of a removable seat such as an infant carrier seat. Such seat may then be used as a carrier, as a car seat, or as a seat used as part of the swing.

SUMMARY OF THE INVENTION

The present invention provides an infant swing having a base, upwardly extending legs, and a motor, preferably a coil-spring wound motor, mounted on the legs, with the axis of the coil-spring motor extending at a predetermined angle from the vertical above the base. A carriage is connected to and oscillated by the motor. A seat is pivotally mounted to the spring and subtends vertically below the point of the pivot mounting. Means are provided for interconnecting the swing support and the carriage so that movement of the carriage also moves the swing support. This arrangement causes the seat to swing in a substantially horizontal arcuate path. Additionally, the seat is removable so that it may be used with the swing or as a infant carrier or infant car seat.

The invention will be more clearly understood from the drawings take together with the specification.

BRIEF DESCRIPTION OF THE DRAWINGS

FIG. 9 is a top view of the swing of FIG. 1;

FIG. 10 is a partial sectional view of the housing and motor drive means of the swing;

FIG. 11 is a partial sectional view of the carriage and interconnection of the spring and the spring alignment shaft;

DETAILED DESCRIPTION OF THE PREFERRED EMBODIMENT OF THE INVENTION

Figure 1:
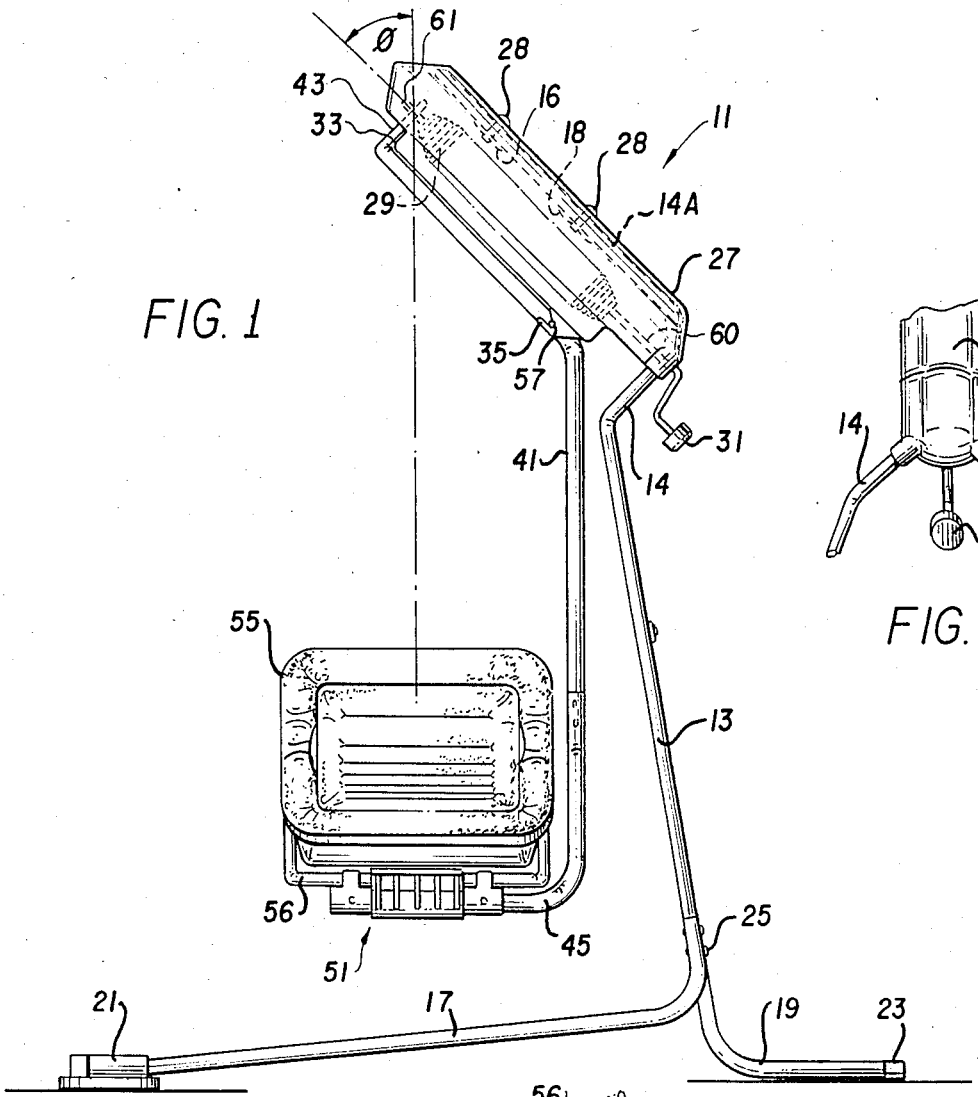
FIG. 1 is a side elevational view of one embodiment of the swing of the present invention.
Figure 6:
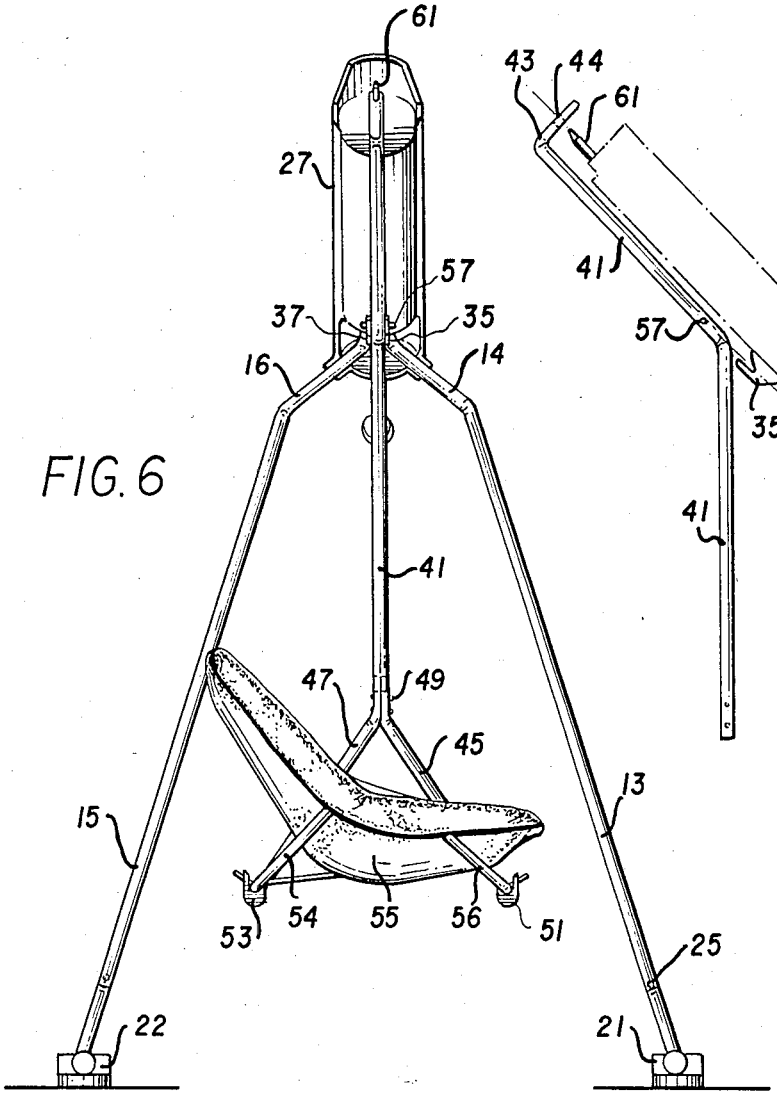
FIG. 6 is a front elevational view of the swing of FIG. 1.

Turning now to FIG. 1, there is shown a side elevational view of one embodiment of the present invention. For purposes of clarity, for the overall view of the swing, reference is also made to FIGS. 6 and 9. Swing 11 includes legs 13 and 15, which are connected to forwardly extending feet 17 and 18 (FIG. 9) and rearwardly extending feet 19 and 20 by means such as rivets or bolts 25. The feet 17 and 18 terminate in pads 21 and feet 19 and 20 terminate in caps 23.

The leg structure is substantially idential for both legs. The upper end of leg 13 includes an angle leg 14 with a subsequent terminal end **14*a* extending at an angle as shown within housing 27. Housing 27 is secured to terminal end 14*a* by means such as plates 16 and 18, which are secured by bolts 28 and associated nuts. A motor, such as spring-wound motor 29, is mounted within the housing in a configuration which will become clear as the description proceeds. Motor 29 is mounted such that its axis is substantially parallel to the axis of the housing and terminal end 14*a* of the leg 13**. As indicated, this provides a mounting of the housing and motor at an angle $\phi$ from the vertical. The reason for such angle will become obvious as the description proceeds.

Swing motor carriage 33 is mounted to and oscillated by spring motor 29, the details of such interconnection being described below.

A swing support, which terminates in a V-shaped base, includes upwardly extending support arm 41, with seat support arms 45 and 47 being secured at the lower end thereof by means such as rivets or bolts 49. Arms 45 and 47 are angled so as to terminate in transverse horizontal ends. These ends have attached thereto latches 51 and 53, which removably secure legs 56 and 54 of seat 55 to the support arm structure.

Figure 7:
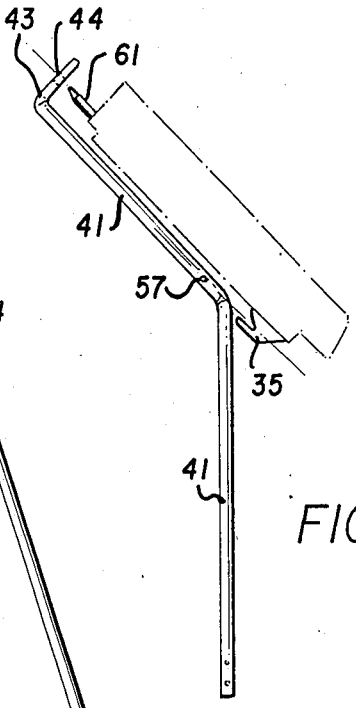
FIG. 7 is a side view of the swing support arm of FIG. 1.

Arm 41 terminates in finger plate 43, having a borehole 44 (FIG. 7) which mates with tapered end 61 of crank 60. This mating establishes the pivot point about which seat 55 oscillates. As indicated, the center of gravity of seat 55 is substantially directly below the pivot point.

Two substantially parallel notched swing support hooks 35 and 37 are secured to and movable with carriage 33. Opposed fingers 57 extend from opposite sides of arm 41 and rest in the notches of hooks 35 and 37. This structure provides further support for the swing and provides a transfer of the oscillatory motion of carriage 33 to seat 55.

The angle $\phi$, referred to above, establishes the radius of the horizontal arcuate movement of the seat and is between 35° and 45°, and preferably between 38° and 42°, with the preferred angle being 40°.

Figure 2:
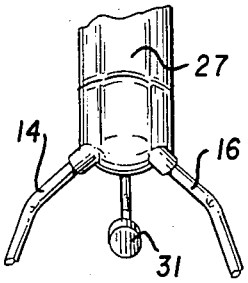
FIG. 2 is a partial rear view of the crank arrangement of the swing of FIG. 1.

FIG. 2 is an end view showing crank arm 31 extending to the rear of housing 27 between angle arms 14 and 16.

Figure 3:
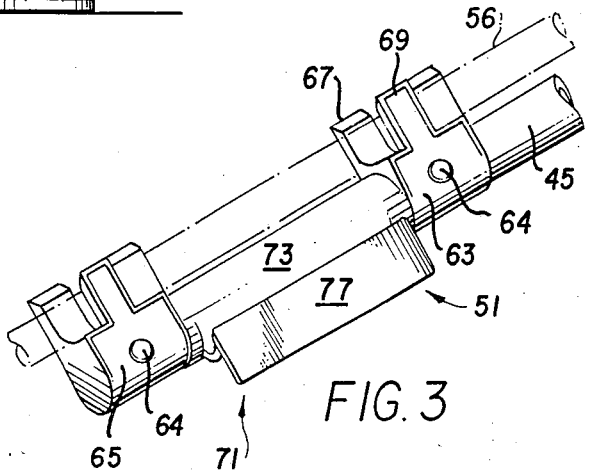
FIG. 3 is a perspective view of the apparatus for removably securing the seat to the swing of FIG. 1.
Figure 4:
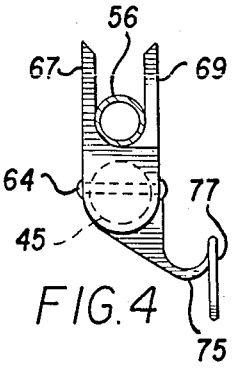
FIG. 4 is an end view showing the securing means of FIG. 3 in an open position.
Figure 5:
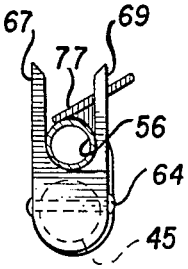
FIG. 5 is an end view showing the securing means of FIG. 3 in a closed position.

Turning now to FIGS. 3, 4, and 5, there is shown the details of the latching means for removably mounting the seat to the support arm structure. Since both latching mechanisms are identical, only one will be described for purposes of clarity.

Latch 51 is secured to transverse arm 45 by means of rivets 64 which pass through cradles 63 and 65 so as to secure the cradles in a fixed position. Each cradle includes opposed teeth 67 and 69 so as to perform a cradling action for leg 56 of seat 55.

Latch member 71 has a cylindrical section 73 which rotatably extends about transverse arm 45. Arcuate arm 75 is integral with cylinder 73 and extends outwardly therefrom and terminates in an integral plate 77. This permits finger movement of the cylinder by grasping plate 77.

In FIG. 4 the cylinder has been rotated so that plate 77 extends outwardly and downwardly from transverse arm 45. In FIG. 4 leg 56 of the seat 55 is shown in place but not secured therein. Once the leg is in place, plate 77 is grasped and cylinder 73 is rotated about transverse arm 45 to the position wherein plate 77 passes over and locks on to leg 56 of the seat. The geometry s such that arcuate arm 75 creates a firm, frictional contact with leg 56.

The seat as illustrated in the drawings is a commercially available infant carrier/car seat. Since it is removable, it may be used as an infant carrier or as a car seat and is easily fitted into place on the swing so that it can be used as a swing seat. Obviously, this provides a very economical swing in that it permits these three uses of the seat.

Figure 8:
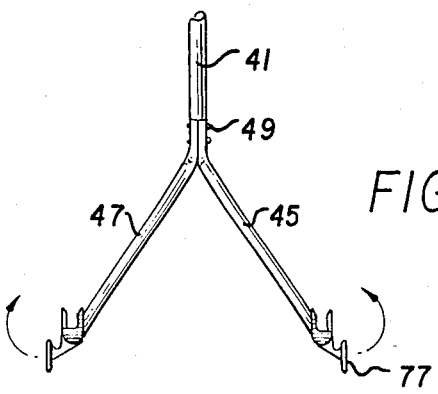
FIG. 8 is a view of the lower seat support structure with the seat removed.

FIG. 8 is a plan view showing the use of the latches as described above.

FIGS. 10–14 disclose a particular spring-motor mechanism which may be used with the present invention. It is to be understood that other motors could be used, whether of the spring-coil type or even electric motors, the only requirement being that the drive mechanism must be so located that it is at an angle from the vertical so that the above-described substantially horizontal oscillatory motion is provided. FIG. 10 is a partial sectional view showing the housing 27 and the crank handle 31, together with swing crank 60, which is an extension of handle 31. The entire length of the swing crank is not shown, but it does terminate in tapered end 61 at the opposite end of the housing. In order to properly describe the operation, reference must be made to all of FIGS. 10–14.

Bracket 81 is mounted to housing 27 by means such as bolt 85. As also can be seen, the housing is such that it provides general support to a number of the components of the spring-actuating mechanism.

Drive spring 97 is mounted about tubing 95 and terminates at one end in arm extension **97*a*, which is secured to flange 98 extending from carriage hook 35. As can be seen from FIG. 1, carriage hook 35 provides an interconnection to finger 57 secured to and extending from swing support arm 41**. As will become obvious from subsequent description, this provides the arcuate horizontal motion to the swing from the motor.

Figure 12:
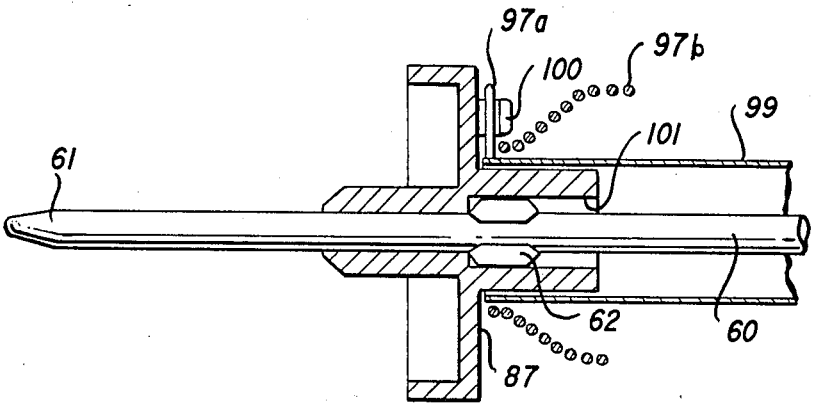
FIG. 12 is a partial sectional view of the spring tensioning mechanism.

As is more clearly shown in FIG. 12, spring 97 encompasses spring alignment shaft 99 with its other terminal end **97*b* being hooked about post 100, which is secured to the face of gear 87. This imparts a bias so as to move the gear in a clockwise direction as viewed from the right of FIGS. 10 and 12. Swing crank 60, which terminates in tapered end 61, mates with slot 101 in gear 87. Key 62 is stamped into crank 60 so as to provide a positive interlock between the gear and the crank. This provides the transmission of the spring tensioning force from crank arm 31 through crank 60 to spring 97**.

Figure 14:
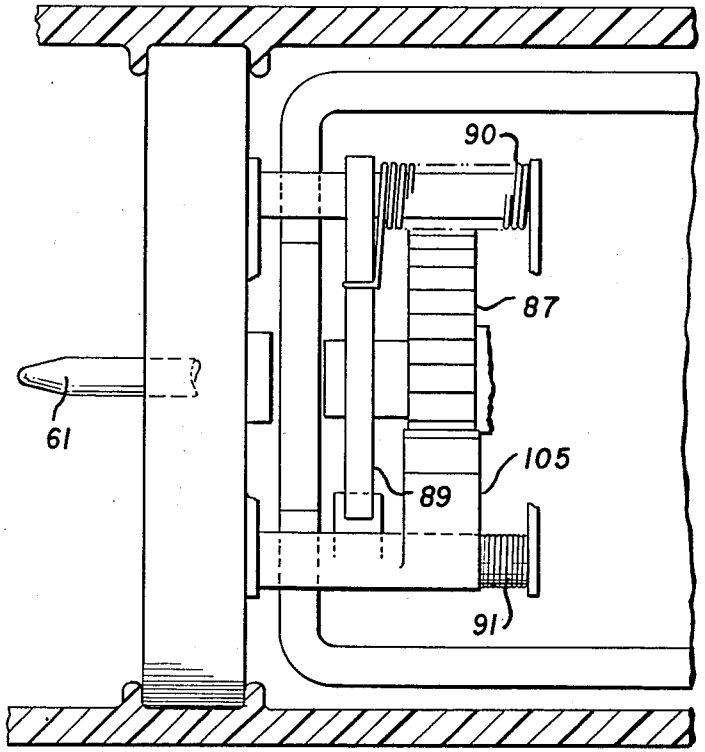
FIG. 14 is a partial sectional top view of the mechanism of FIG. 13.
Figure 13:
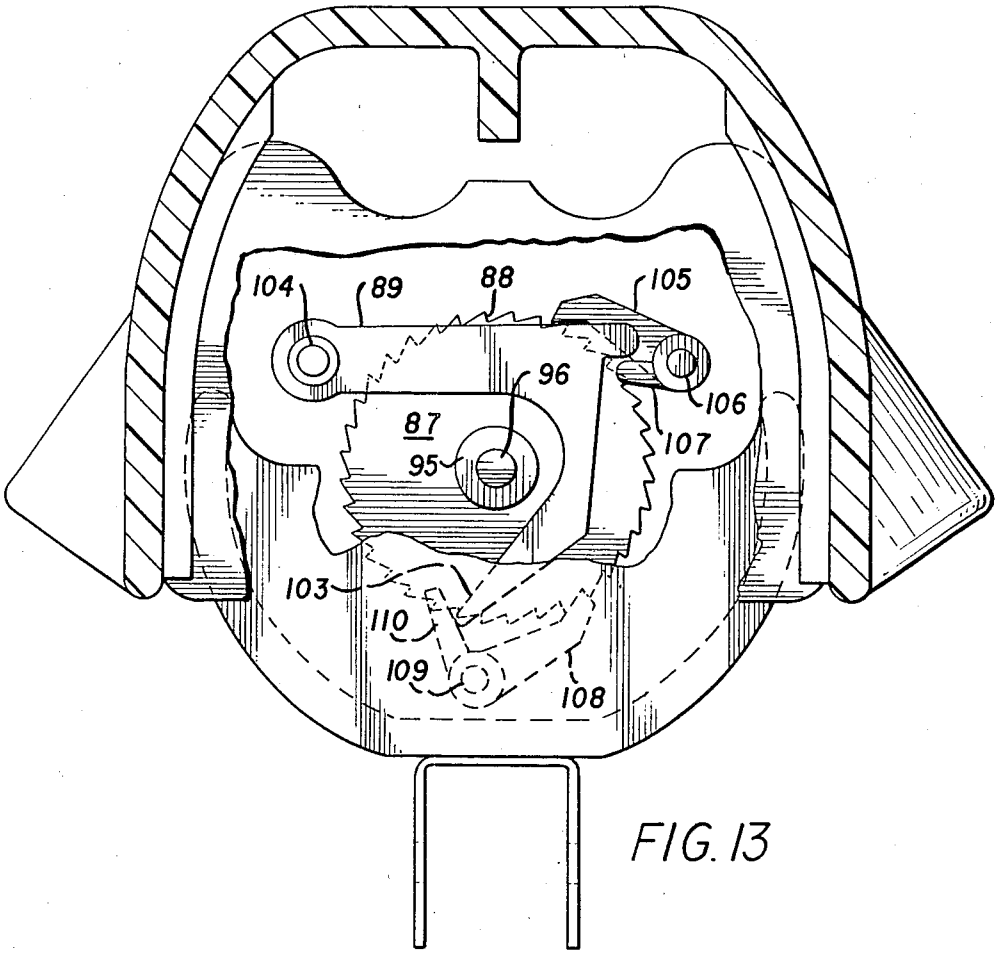
FIG. 13 is a partial sectional end view of the gear and pawl mechanism.

Referring to FIGS. 10, 13, and 14, associated with gear 87 (which is mounted about pivot point 96) are actuator arm 89 pivoted at 104, upper ratchet pawl 105 pivoted at 106 which includes an arm 107, and lower pawl 108 pivoted at 109 and including arm 110. Actuator arm 89 is configured in a U-shape and terminates in finger 103.

The arm 107 of upper pawl 105 is activated by actuator arm 89 causing pawl 105 to disengage from the teeth of the ratchet gear 87. The arm 110 of the lower pawl 108 is also activated by actuator arm 89 causing pawl 108 to disengage the teeth of ratchet gear 87. The actuation are synchronized to the position of the housing 33 and operate as an escapement mechanism. The sequence of the operation of the escapement follows shortly.

Actuator arm 89 and pawls 105 and 108 are all spring-biased. These springs are indicated more clearly in FIGS. 10 and 14. Spring 90 biases actuator arm 89 while spring 91 biases upper ratchet pawl 105. Spring 111 biases lower ratchet pawl 108.

Before explaining the sequential operation of the motor, the following conditions should be noted.

When upper ratchet pawl 105 is engaged with gear 87 and lower ratchet pawl 108 is disengaged, the mechanism is in a power, or drive, position.

When upper ratchet pawl 105 is disengaged with gear 87 and lower ratchet pawl 108 is engaged with gear 87, the drive mechanism is in a neutral, or rest, position.

Because of the arrangement of the ratchet pawls, gearing, and springs with the carriage and the housing, the motion created by the motor mechanism alternately and effectively connects spring 97 in two configurations. In the first configuration, spring 97 is connected to the housing at one end and the carrige at the other end. In the other configuration, both ends of spring 97 are effectively connected to the carriage. If the spring is effectively connected between the housing and the carriage, this equals a power position. If both ends of the spring are effectively connected to the carriage, there is a neutral position. It is to be understood that the power position creates a drive for the swing in one direction and the neutral position allows the swing to move to the opposite position under the influence of gravity. Accordingly, the power and neutral positions are alternately imposed.

The following is a sequence of operation for use of the swing.

1. Crank handle 31 is rotated to wind motor spring 97 so that a clockwise force is imparted through gear 87, again as viewed from the crank handle end.

2. Seat 55 is manually moved to start the motion. Upper ratchet pawl 105 and lower ratchet pawl 108 will successively engage and disengage with the teeth of ratchet gear 87. Movement is controlled by spring-loaded actuator arm 89 acting upon spring-loaded upper ratchet pawl 105 and spring-loaded lower ratchet pawl 108. It is through these components that the spring is allowed to impart or not impart power to the swing chair, as described above. To explain further, one end of spring 97 is permanently attached to the carriage by means of flange 98. The other end of the spring is attached to gear 87. Through the interaction of actuator arm 89, upper ratchet pawl 105, and lower ratchet pawl 108 with gear 87, the end of spring 97 is effectively and alternately tranferred from the housing to the carriage and back. When upper ratchet pawl 105 is engaged with teeth 88 of gear 87, power is imparted from the other end of spring 97 to plate 98 and swing support hook 35 to support arm 41 so as to swing the chair pendulum. As the pendulum moves slightly past the center of the swing path, the lower actuator pawl 108 engages teeth 88 of gear 87, allowing upper ratchet pawl 105 to disengage; this is the position shown in FIG. 13. This effectively connects both ends of spring 97 to swing motor carriage 33, which will not allow the spring to impart power to arm 41. This is what is referred to above as the neutral position.

3. Energy is released from the end fartherest from the gear which is connected to chair support hooks 35.

If it is desired to stop the oscillation of the chair before the spring is totally unwound, the chair may be manually held in its substantially central position and the spring will not actuate further unless the seat is manually moved, as discussed above.

This motion mechanism provides the desired arcuate oscillatory horizontal motion described above and as indicated by the arrows in FIG. 9. Again, this closely simulates the rocking action which an infant receives when held in the arms of the parents and is rocked from side-to-side, as is a very normal rocking action.

The above description and accompanying drawings are illustrative, only, since various components could be substituted without departing from the invention, the scope of which is to be limited only by the following claims.

I claim:

1. An infant swing comprising
support means including legs;
oscillatory spring motor means;
means for mounting said motor means above said support means so that the axis of said motor means is inclined at a predetermined angle substantially less than a 90° inclination from a vertical line extending above said support;
a rotatable carriage mounted to and oscillated by said motor means, the longitudinal axis of said carriage being substantially parallel to the longitudinal axis of said spring motor means;
an infant seat;
means for pivotally mounting said seat to and substantially vertically below said motor means; and
means for interconnecting said means for pivotally mounting said seat to said carriage whereby said seat is oscillated with said carriage.

2. The swing of claim 1 wherein the center of gravity of said seat is located substantially perpendicularly below the point at which said seat is pivotally mounted to said motor means.

3. The swing of claim 1 wherein said means for mounting said seat comprises
substantially horizontal rod for supporting said seat;
a substantially vertical rod connected to and extending upwardly from said horizontal rods;
an angled rod connected to and extending upwardly from the distal end of said vertical rod; and
a plate having a borehole therein at the distal end of said angled rod for mounting to said motor means.

4. The swing of claim 1 further comprising latches secured to said means for pivotally mounting said seat for removably mounting said infant seat to said means for pivotally mounting said seat.

5. The swing of claim 1 wherein said oscillating spring motor means comprises
a coil spring motor; and
a driving gear and associated ratchet pawls.

6. The swing of claim 1 wherein said predetermined angle is between 35° and 45°.

7. The swing of Claim 1 wherein said predetermined angle is between 38° and 42°.

8. The swing of claim 1 wherein said predetermined angle is 40°.

9. An infant swing comprising
a stand including legs and an upwardly extending support means;
oscillatory motor means;
means for mounting said motor means above said support means so that the axis of said motor means is inclined at a predetermined angle substantially less than a 90° inclination from a vertical line extending above said suport;
a carriage secured to and oscillated by said motor means;
an infant seat;
means for pivotally mounting said seat to said means for mounting said motor means, said seat depending substantially vertically below said carriage; and
means interconnecting said means for pivotally mounting said seat with said carriage whereby said seat oscillates with said carriage.

10. The swing of claim 9 wherein the center of gravity of said seat is located substantially perpendicularly below the point at which said seat is mounted to said means for mounting said motor means.

11. The swing of claim 9 further comprising
latches secured to said means for mounting said seat for removably securing said seat to said means for mounting said seat.

12. The swing of claim 9 wherein said oscillating motor means comprises
a coil spring motor; and
a driving gear and associated ratchet pawls.

13. The swing of claim 9 wherein said predetermined angle is between 35° and 45°.

14. The swing of claim 9 wherein said predetermined angle is between 38° and 42°.

15. The swing of claim 9 wherein said predetermined angle is 40°.

16. An infant swing comprising
support means including legs and upper arms;

a carriage;

means for rotatably securing said carriage to said support means so that said carriage is inclined at a predetermined angle substantially less than a 90° inclination from a vertical line extending above said support means;

motor means mounted on said support means and drivably connected to said carriage for oscillating said carriage ;

an infant seat;

means for pivotally mounting said seat to said support means and vertically below said carriage; and means interconnecting said means for pivotally mounting said seat and said carriage whereby oscillation of said carriage by said motor oscillates said seat.

17. The seat of claim 16 further comprising latches secured to said means for pivotally mounting said seat for removably mounting said seat to said means for pivotally mounting said seat.

18. The seat of claim 16 wherein said motor means comprises a coil spring motor and associated driving gear and ratchets.

19. The swing of claim 16 wherein said predetermined angle is between 35° and 45°.

20. The swing of claim 16 wherein said predetermined angle is between 38° and 42°.

21. The swing of claim 16 wherein said predetermined angle is 40°.

22. An infant swing comprising a base;

legs connected to and extending upwardly from said base;

carriage means means for rotatably supporting said carriage means from the distal ends of said legs, said carriage means extending at a predetermined angle substantially less than a 90° inclination from a vertical line extending above said base;

motor means connected to said carriage for oscillating said carriage;

an infant seat and support;

an arm connected to and extending above said support, the distal end of said arm terminating in a portion extending at a predetermined angle from said arm, said angle being substantially the same as said predetermined angle between said carriage means and said vertical line extending above said base; and means for rotatably mounting said distal end of said arm to said means for supporting said carriage means, said distal end of said arm extending substantially parallel to said carriage means; and means for connecting said distal end of said arm to said carriage means whereby said oscillation of said carriage by said motor means oscillates said seat in a substantially horizontal arcuate path.

* * * * *